United States Patent [19]

Jackson, II et al.

[11] Patent Number: 4,519,502

[45] Date of Patent: May 28, 1985

[54] RACK FOR BOXED PLASTIC BAG ROLLS

[75] Inventors: John C. Jackson, II; Robert N. Schendle, both of Monroe, La.

[73] Assignee: Sunbelt Plastics, A Division Of Sunbelt Manufacturing, Inc., Monore, La.

[21] Appl. No.: 581,113

[22] Filed: Feb. 16, 1984

[51] Int. Cl.[3] ..... B65D 83/00; B65D 85/672; B65B 67/04

[52] U.S. Cl. ..... 206/390; 206/54; 206/395; 220/407

[58] Field of Search ..... 206/390, 54, 396, 395, 206/397; 220/407

[56] References Cited

U.S. PATENT DOCUMENTS

| | | | |
|---|---|---|---|
| 406,517 | 7/1889 | Darby et al. | 206/54 |
| 3,880,287 | 4/1975 | Loeffelman | 206/395 |
| 4,364,490 | 12/1982 | Lang et al. | 206/390 |

*Primary Examiner*—William T. Dixson, Jr.
*Attorney, Agent, or Firm*—Harvey B. Jacobson

[57] ABSTRACT

A wire rack for supporting a box or carton containing a roll of flexible plastic bags with the rack being capable of quick and easy supporting engagement with the upper edge of a trash receptacle, janitorial cart and the like. In one embodiment, the wire rack is curved in a manner to conform with and engage the upper open end of a large waste receptacle of cylindrical configuration. In another embodiment, the wire rack is straight for mounting on the upper end of a maid's or janitor's cart. In both embodiments of the invention, the wire rack includes a locking arrangement by which opposite legs of the rack which straddle the box or carton will lockingly engage with a slotted end of the carton with the inner end of the locking arrangement being inserted into the hollow core on which the roll of plastic bags are wound.

8 Claims, 4 Drawing Figures

RACK FOR BOXED PLASTIC BAG ROLLS

BACKGROUND OF THE INVENTION

1. Field of the Invention

The present invention generally relates to a structure which enables a carton of plastic trash bags or waste receptacle liners to be conveniently supported from various types of janitorial carts, wheeled waste receptacles and the like without requiring any additional parts, tools or labor to effectively support the carton of plastic bags from the cart or waste receptable thereby securely and effectively supporting the plastic bags so that they are readily available for use by personnel engaged in trash pickup, cleaning and the like.

2. Description of the Prior Art

Various types of supporting racks, brackets and the like have been provided for conveniently supporting various items in a desired location. Included in such devices are wall mounted racks for supporting a roll of plastic bags which are formed in a continuous roll with lines of separation between adjacent bags. Such bags are used for various purposes such as the bagging of vegetables, fruits and other produce in grocery stores, as covers for garments which have been dry cleaned and as liners for trash cans as well as other various uses. When the plastic bags are supported from a wall surface at the point of use, various types of conventional racks for rolls of materials can be used. However, when the roll of plastic bags must be carried to a site of use, problems have been encountered in properly handling the roll of bags. For example, when a janitor, cleaning personnel or the like are cleaning, the plastic bag liners that are in trash cans are removed and a new liner placed therein which requires considerable time in picking up the roll of plastic bags and removing one and then returning the roll of plastic bags to its storage area after which the removed bag can be placed in the trash can.

The following U.S. Patents are relevant to this invention but do not disclose equivalent structures:

| | |
|---|---|
| 2,763,310 | Sept. 18, 1956 |
| 3,175,793 | March 30, 1965 |
| 3,586,276 | June 22, 1971 |
| 3,749,346 | June 31, 1973 |
| 4,094,416 | June 13, 1978 |

SUMMARY OF THE INVENTION

An object of the present invention is to provide a wire rack for quickly, easily and conveniently supporting a carton which contains a roll of plastic bags from a janitorial cart, large round wheeled waste receptacle or the like so that the plastic bags are readily available to cleaning personnel or others using such bags.

Another object of the invention is to provide a rack in accordance with the preceding object in which the wire rack is generally of inverted U-shaped construction with generally parallel legs straddling the carton and extending alongside of the end walls thereof with the free ends of the legs including a locking device which is inserted into a slot provided in each end of the carton for locking the legs of the rack to the carton to provide secure interconnection between the rack and carton.

A further object of the invention is to provide a rack in accordance with the preceding objects in which the free end of the legs includes an inner end portion which extends into the hollow core on which the plastic bags are wound thereby rotatably securing and supporting the hollow core centrally in the carton to facilitate dispensing of the plastic bags through a slot or similar opening in the carton.

Still another object of the invention is to provide a rack in accordance with the preceding objects in which the bight portion of the rack is angulated to fit over and conform with the upper edge of a large round waste receptacle.

A still further object of the invention is to provide a rack in accordance with the preceding objects in which the bight portion of the rack is straight for engagement over a horizontal rod or other horizontal support structure incorporated into a janitorial cart or the like.

Yet another important object of the invention is to provide a wire rack in accordance with the preceding objects which is effective and dependable in supporting the carton and roll of plastic bags in a convenient location for use and which is relatively inexpensive to manufacture and simple to assemble with respect to the plastic bag carton and the supporting cart or waste receptacle.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 4 is a perspective view of a modified form of wire rack in which the bight portion is straight for engagement with a janitorial cart or the like.

DESCRIPTION OF THE PREFERRED EMBODIMENTS

Figure 1:
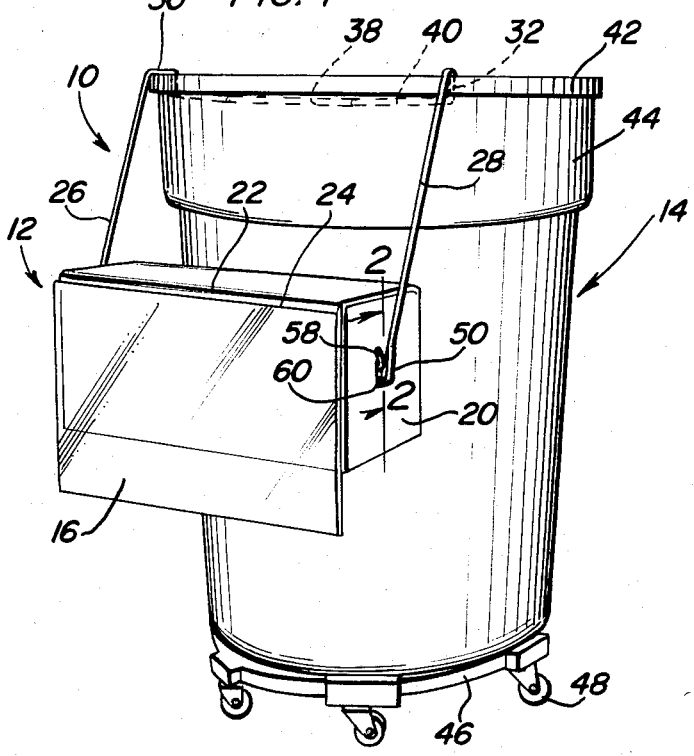
FIG. 1 is a perspective view of the wire rack of the present invention supporting a carton with a roll of plastic bags therein from the upper edge of a large round waste receptacle.
Figure 2:
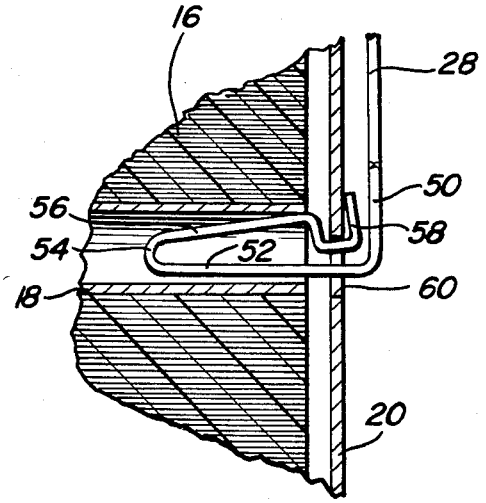
FIG. 2 is a sectional view, on an enlarged scale, taken substantially upon a plane passing along section line 2—2 on FIG. 1 illustrating the structural details of the structure which locks the rack to the carton and the projection which extends into the hollow core of the roll of plastic bags.
Figure 3:
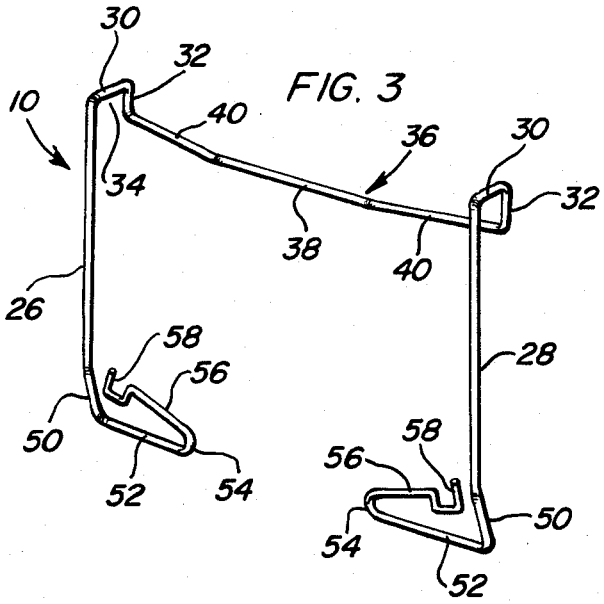
FIG. 3 is a perspective view of the wire rack illustrated in FIG. 1.

Referring now specifically to FIGS. 1–3 of the drawings, the rack of the present invention is generally designated by reference numeral 10 and in FIG. 1, the rack 10 is illustrated in its use for supporting a carton 12 from a large round wheeled waste receptacle generally designated by the numeral 14 with the carton 12 including a roll of plastic bags 16 mounted on a hollow core 18 of cardboard or the like. The plastic bags 16 are conventional in construction and are formed as a continuous web with lines of separation so that individual bags can be removed from the roll for use in lining trash cans or for other purposes in collecting trash, refuse and the like.

The carton 12 includes end walls 20 which are interconnected by peripheral walls 22 with a dispensing slot 24 being formed in the upper outer corner of the carton 12 as illustrated in FIG. 1 to enable the plastic bags to be unwound from the core 18 and individually removed from the web and used.

The rack 10 is constructed of one-piece of wire and is generally of U-shaped configuration and includes a pair of generally parallel legs 26 and 28, each of which has its upper end formed into a laterally extending portion 30 that is perpendicular with the respective leg and extends laterally of a plane extending between the legs 26 and 28. The laterally extending portion 30 terminates in a short downwardly extending portion 32 which parallels the legs and lies in the same plane as the respective legs 26 and 28 with the portions 30 and 32 defining a downwardly opening channel-shaped area 34. The lower ends of the downwardly extending portions 32 are interconnected by a web 36 which includes a central portion 38 and outer end portions 40 with the outer end portions 40 being angulated in relation to the central portion 38 with the central portion 38 being closer to a plane extending between the legs 26 and 28 then the downwardly extending portions 32 thereby providing a generally arcuately curved or angulated web 36. This construction of the web 36 adapts the rack 10 for engagement over the upper end 42 of the trash receptacle 14 which includes a cylindrical peripheral wall 44 at its upper end portion and a reversely curved or folded lip forming the upper end 42. The lower end of the trash receptacle is provided with a supporting frame structure 46 and wheels 48 which may be caster wheels or the like or the wheels 48 may be attached directly to the receptacle 14 or the rack 10 may be attached to a receptacle that is not wheeled. The angulated or arcuately curved web 36 conforms generally with the inner surface of the trash receptacle 14 so that various articles can be placed in the trash receptacle without coming into contact with the web 36. Thus, with this construction, the rack 10 may be quickly and easily hooked over the upper end of the trash receptacle 14 with the downwardly opening channels 34 receiving the upper end of the trash receptacle as designated by numeral 42 with the legs 26 and 28 extending downwardly and diverging from the peripheral wall 44 as illustrated in FIG. 1 for contacting engagement with the carton 12.

Each of the legs 26 and 28 is provided with an angulated lower end portion 50 terminating in an inwardly extending lower end 52 that is reversely bent at 54 to form an inwardly extending projection. The rack includes an outwardly and upwardly inclined portion 56 extending from the reverse bend 54 with the terminal end of the outwardly extending portion 56 terminating in an upwardly facing U-shaped or hook-shaped end portion 58. The end wall 20 of the carton 12 includes a slot 60 oriented centrally therein with the slot having a length which enables insertion of the inwardly extending lower end of each of the legs as illustrated in FIG. 2. When inserting the projection on the lower end of the legs 26 and 28, the upwardly angled member 56 is moved downwardly to a collapsed or retracted condition so that it can be inserted into and through the slot 60 after which the resiliency of the material expands the upwardly opening U-shaped end portion or hook 58 into engagement with the upper end of the slot 60 as illustrated in FIG. 2. In this position, the reversely curved inner end portion 54 is disposed interiorly of the core 18 so that a rotational support for the core 18 is provided thereby maintaining the roll of bags 16 centralized in the carton 12 to facilitate the flexible bags being pulled off and unwound from the core 18. The engagement of the inward projection of the wire legs with the core 18 not only stablizes the core but also provides frictional engagement therewith so that the roll of plastic bags will not freely rotate as might occur if the outermost bag on the roll is rapidly jerked or snatched by the person removing the endmost bag from the web of bags. This locking feature also locks the legs to the carton to provide a positive connection therebetween thereby providing a secure but readily attached supporting rack for supporting the carton and the roll of plastic bags from the trash receptacle 14.

Figure 4:
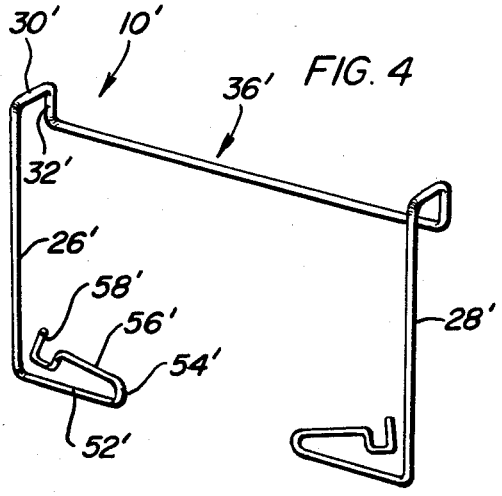

FIG. 4 illustrates a modified embodiment of the invention generally designated by numeral 10' in which the web 36' is completely straight and the lower ends of the legs 26' and 28' are straight and not provided with any angulated or oblique portion such as designated by reference numeral 50 in FIG. 3. This embodiment of the invention is specifically adapted to be supported from a straight supporting side rod or rail of a janitorial cart, maid cart of the like. In both embodiments of the invention, the carton containing the roll of plastic bags is quickly, easily and securely supported from a cart, trash receptable or the like so that the carton and the plastic bags therein may be easily moved along with the cart or trash receptacle with the easy access and removal of the plastic bags reducing the time necessary to remove filled or partially filled trash can liners and replace them with empty plastic bags or liners. This structure also maintains the carton and plastic bags in a secure manner thereby eliminating problems encountered such as those which occur when the roll of plastic bags has been removed from the carton and carried to a place of use which sometimes results in entangledment of the bags, unwinding of the bags from the roller or core and considerable labor and aggravation in removing a single bag for use when cleaning offices, homes and the like.

The wire may be chrome plated and is preferably steel wire which can be formed by conventional machinery with one successful embodiment of the invention including seven-gauge wire.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A rack for supporting a carton containing a roll of flexible rolled material having a hollow core to enable the material to be dispensed from the carton through a dispensing slot therein, said rack comprising a support member including a pair of legs straddling the carton and extending alongside opposite walls thereof, each leg terminating in an inwardly extending projection, each projection including means for extending through an opening in the wall of the carton and for being locked to the wall of the carton to secure the legs to the carton and extending into supporting engagement with the hollow core of the rolled material, and a connecting member extending between the ends of the legs remote from the carton for engagement with a supporting structure.

2. The rack as defined in claim 1 wherein said means on the inwardly extending projection on each leg includes an inwardly extending reversely bent extension on the end of the leg with the free end of the reversely bent extension including a laterally opening recess adjacent the leg to enable the reversely bent extension to be inserted through the opening in the wall of the carton with the laterally opening recess receiving a peripheral portion of the opening to secure the leg to the wall of the carton and secure the carton to the legs of the rack, said reversely bent inner end portion of each projection extending into the hollow core of the rolled material to support the rolled material, said means interconnecting the legs remote from the carton including a connecting member, each of the legs including a reversely bent upper end portion defining a pair of downwardly opening channels for engagement over the upper edge of a supporting structure.

3. The rack as defined in claim 2 wherein the connecting member is angulated to conform with the interior surface of the upper edge portion of a large round trash receptacle for hanging the carton tangentially of the periphery of the trash receptacle below the upper edge thereof.

4. The rack as defined in claim 2 wherein said connecting member is straight for engagement over the upper rail or frame member of a janitorial cart to support the carton alongside of the cart.

5. In combination, a carton having a roll of plastic bags therein and a slot enabling the plastic bags to be dispensed from the roll, said roll of plastic bags including a hollow core with the roll of bags and core extending horizontally between vertical end walls of the carton with the end walls of the carton having apertures aligned with the core when oriented centrally of the carton, a supporting rack engaged with the carton and including means for engaging a supporting structure, said rack comprising a pair of spaced legs having free ends engaged with the carton, the free end of each leg including an inwardly extending extension having a reversely curved inner end portion and a resilient and outwardly diverging portion terminating in a laterally opening recess with the extension received through the aperture in the end wall of the carton and extending into the core when the outwardly diverging portion of the extension is moved toward the extension with release of the outwardly diverging portion of the extension engaging the laterally opening recess into locking engagement with the periphery of the aperture in the end wall of the carton and the inner end portion of the extension in the core.

6. The combination as defined in claim 5 wherein said means on the rack engaging a supporting structure includes a connecting member extending between the legs at a point remote from the free ends thereof, said connecting member including portions conforming generally with the interior of the peripheral wall of a cylindrical waste receptacle.

7. The combination as defined in claim 5 wherein said means on the rack engaging a supporting structure includes a connecting member extending between the legs at a point remote from the free ends thereof, said connecting member including a straight portion for engaging a horizontal member on a janitorial cart.

8. The combination as defined in claim 5 wherein said rack is of unitary one-piece rod-like construction of resilient material to enable the free ends of the legs to be spread apart sufficiently to insert the extensions into the end wall apertures with the resiliency of the rack biasing the legs into a position adjacent the outer surface of the end walls, said means for engaging a supporting surface including a supporting hook formed on the end of each leg remote from the extension thereon with the hook opening toward the extension for hooking over the edge of a receptacle or the like to support the carton alongside of the receptacle with the plastic bags accessible for lining a trash can and the like, the resilient outwardly diverging portion of the extension having a major portion of its length inserted into the core of the roll of plastic bags to centralize the core in relation to the apertures in the end walls to maintain the roll of plastic bags centralized in the carton to facilitate movement through the slot in the carton through which the plastic bags pass, the resiliency of the extension assuring frictional contact between the extension and the core to restrict free rotational movement of the roll of plastic bags to prevent a plurality of the plastic bags from being unrolled from the roll due to sudden outward movement of the endmost plastic bag when grasped and pulled.

* * * * *